United States Patent [19]

Mukunoki et al.

[11] Patent Number: 4,917,993

[45] Date of Patent: Apr. 17, 1990

[54] SILVER HALIDE PHOTOGRAPHIC MATERIALS

[75] Inventors: Yasuo Mukunoki; Masakazu Yoneyama; Sumito Yamada, all of Kanagawa, Japan

[73] Assignee: Fuji Photo Film Co., Ltd., Kanagawa, Japan

[21] Appl. No.: 286,030

[22] Filed: Dec. 19, 1988

[30] Foreign Application Priority Data

Dec. 18, 1987 [JP] Japan ..... 62-320702

[51] Int. Cl.[4] ..... G03C 1/76

[52] U.S. Cl. ..... 430/523; 430/527; 430/531; 430/627; 430/631; 430/635; 430/637; 430/966; 568/608; 568/624; 568/625

[58] Field of Search ..... 430/523, 527, 531, 627, 430/631, 635, 637, 966; 568/608, 624, 625

[56] References Cited

U.S. PATENT DOCUMENTS

| | | | |
|---|---|---|---|
| 3,625,692 | 12/1971 | Meyer et al. | 430/631 |
| 3,725,080 | 4/1973 | Mackey | 430/637 |
| 4,542,095 | 9/1985 | Steklenski et al. | 430/523 |
| 4,596,766 | 6/1986 | Nemori et al. | 430/527 |
| 4,675,278 | 6/1987 | Sugimoto et al. | 430/531 |

*Primary Examiner*—Hoa Van Le

*Attorney, Agent, or Firm*—Sughrue, Mion, Zinn, Macpeak & Seas

[57] ABSTRACT

A silver halide photographic material comprising a support having thereon at least one light-sensitive silver halide emulsion layer and at least one other hydrophilic colloid layer, wherein at least one compound represented by formula (I) is contained in at least one layer of the silver halide photographic material and wherein an organic material selected from the group consisting of a natural or synthetic water-soluble polymer is contained in at least one of the light-sensitive silver halide emulsion layer and the other hydrophilic colloid layer such that at least 10% by weight of the organic material originally present in the layers of the silver halide photographic material is washed out from the layer during development processing:

$$A—X—Y—B \qquad (I)$$

wherein A represents an alkyl group, an alkenyl group or an aryl group, which has from 8 to 25 carbon atoms; X represents $$-O-,\ -\underset{\underset{O}{\|}}{C}O-,\ -S-,\ -\underset{\underset{R}{|}}{N}-,\ -\underset{\underset{R}{|}}{C}ON-,\ \text{or}\ -SO_2\underset{\underset{R}{|}}{N}-$$

wherein R represents an alkyl group having from 1 to 10 carbon atoms or —Y—B; Y represents a group consisting of at least one of each of the units $$\left(CH_2-CH_2O\right)_a \text{ and } \left(CH_2\underset{\underset{OH}{|}}{C}HCH_2O\right)_b.$$

wherein a represents from 5 to 50; and b represents from 2 to 20; and B represents hydrogen or an alkyl group having not more than 8 carbon atoms, an alkylcarbonyl group having not more than 8 carbon atoms, or a phenyl group having not more than 8 carbon atoms.

6 Claims, No Drawings

SILVER HALIDE PHOTOGRAPHIC MATERIALS

FIELD OF THE INVENTION

The present invention relates to silver halide photographic materials (referred to hereinafter as sensitive materials). More particularly, the present invention concerns the improvement of the rapid processing characteristics, including the provision of high speeds with short processing times and the provision of shorter drying times without image blurring or contamination of the development processing baths, and the improvement of the antistatic properties of X-ray sensitive materials and black-and-white sensitive materials in particular.

BACKGROUND OF THE INVENTION

Sensitive materials generally consist of a support which has electrical insulating properties and a photographic layer: Considerable electrostatic charge accumulates as a result of contact friction with the surface of a similar or different type of material or on peeling during the manufacture or use of the sensitive material. Such an accumulated electrostatic charge causes various problems, the most serious of which is the formation of spots, or tree or feather like lines, due to the discharge prior to development processing, of the electrostatic charge which has accumulated during exposure of the photosensitive emulsion layers or during the development processing of the photographic film. These marks are known as static marks and their presence results in a marked reduction in the quality of a photographic film and, depending on the actual case, it can completely destroy the commercial value of a given material. For example, such marks can easily lead to faulty conclusions with potentially serious consequences if they appear on X-ray films used for medical or industrial purposes. The phenomenon becomes first clear after the completion of development. Furthermore, there are secondary problems in that the accumulated electrostatic charge may cause dust to stick to the surface of the film, or lead to problems with uneven coating.

Such electrostatic charges often accumulate during the manufacture and use of sensitive materials and they may be produced, for example, by contact friction between the photographic film and rollers during the manufacturing process, or as a result of separation of the support surface from the emulsions surface on winding and unwinding the film. Furthermore, electrostatic charges can also be generated by the separation of the emulsion surface from the base surface when winding and cutting photographic film in the finishing process, and as a result of X-ray film making contact with, and separating from, mechanical parts or fluorescence sensitizing papers in automatic cameras. Electrostatic charges can also be generated by contact with packaging materials, etc. The static marks on sensitive materials brought about by the accumulation of such electrostatic charges becomes more of a problem as the speed of the sensitive material increases and as the processing rate is increased. In more recent times in particular, the problem of static marks has become more acute as a result of the increased speed of the sensitive materials and the increased opportunity for vigorous handling such as high speed coating, high speed shooting, and high speed automatic development processing.

The addition of antistatic agents to sensitive materials for preventing these problems due to static electricity from arising is clearly desirable. However, the antistatic agents which can be used in sensitive materials are generally not the same as those used in other applications due to various limitations imposed by the sensitive material. As well as having excellent antistatic properties, the antistatic agents used in sensitive materials must have no adverse effect on the photographic characteristics of the sensitive material, such as speed, fog, graininess or sharpness, etc. These antistatic agents must not have an adverse effect on the film strength (such that they must not result in the film becoming liable to damage by wear or scratching), they must not have an adverse effect on the anti-stick properties of the sensitive material (such that they do not cause the material to adhere to the surface of similar photographic material or other materials), they must not cause the processing baths of the sensitive material to become exhausted, they must not contaminate transport rollers and they must not reduce the strength of adhesion between the various layers which make up the sensitive material. Clearly many limitations are imposed on the application of antistatic agents to sensitive materials.

In one method of overcoming the problems caused by static electricity, the electrical conductivity of the surface of the sensitive material is increased so that the static charge is dispersed quickly before it is able to accumulate and discharge.

Hence, consideration has been given in the past to methods by which the electrical conductivity of the support and the various coated surface layers of the sensitive material can be raised, and attempts have been made to use various hygroscopic substances, water-soluble inorganic salts and various surfactants and polymers, etc., to achieve this goal.

Among these materials, surfactants that are of importance from the point of view of their antistatic performance include the anionic, betaine and cationic surfactants and the nonionic surfactants as disclosed in JP-B No. 48-17882 (the term "JP-B" as used herein refers to an "examined Japanese patent publication"), JP-A No. 52-80023 (the term "JP-A" as used herein refers to a "published unexamined Japanese patent application"), in West German Pat. Nos. 1,422,809 and 1,422,818, and in Australian Pat. No. 54,441/1959, etc., are well known.

However, these substances are specific with respect to the type of film support and photographic composition employed. Those which provide good results with certain specified film supports, photographic emulsions and other photographic structural elements may have no antistatic effect at all with regard to other film supports and photographic structural elements. Even if these substances do have excellent antistatic properties, they may have an adverse effect on photographic characteristics of the photographic emulsion, such as speed, fog, graininess or sharpness, etc., or they may cause contamination of the development processing baths, or they may cause the material to stick to rollers, etc. Thus, it is very difficult to make use of these substances in sensitive materials.

Furthermore, the antistatic techniques employing nonionic surfactants closely depend on the coating agents which are used conjointly. Rapid progress has been made with respect to the antistatic performance of these materials, but more consideration must be given to contamination of development processing baths and transport rollers by these antistatic materials which can cause serious film problems.

For example, the ethylene oxide adducts of phenol-formaldehyde condensates disclosed in JP-B No. 5-9610 provide excellent antistatic performance, even when they are used conjointly with various coating agents. However, the problems due to contamination during the course of development processing are not resolved with the method disclosed in the patent.

Furthermore, sensitive materials which contain specified anionic surfactants and polyoxyethylene-based nonionic surfactants have been disclosed in JP-A No. 53-29715 but, as in the case of JP-A No. 51-9610 mentioned above, there is no improvement with respect to the problems which arise as a result of contamination of the development processing baths and transporting rollers.

There are methods of overcoming these contamination problems with the use of the polyoxyethylene-based nonionic surfactants, the anionic surfactants which contain polyoxyethylene groups, and the fluorine-containing anionic surfactants disclosed in JP-A Nos. 60-76741 and 60-76742.

On the other hand, in recent years the speed of development processing of sensitive materials has been increased using high temperature rapid processing systems and processing times have been greatly reduced with the automatic development machine processing of various types of sensitive materials. Development baths with which sufficiently high speed can be realized in a short period of time and sensitive materials which have excellent development properties and which have to residual coloration even with short processing times, and which dry quickly are required for high temperature rapid processing. A drying zone is incorporated into most automatic developing machines. If the drying properties of the sensitive materials are poor, then a higher drying capacity is required and the size of the machine is inevitably increased. Furthermore, more heat is generated and this effects temperatures in the room in which the automatic developing machine is housed in.

Work has been directed at providing sensitive materials which dry as quickly as possible in order to overcome these problems. The methods generally used involve adding a suitable amount of a film hardening agent prior to, or during the coating of the sensitive material in order to minimize swelling of the emulsion layers and the surface protective layers during the course of development, fixing and water washing. Thus, the water content of the sensitive material is reduced prior to the commencement of drying. It is possible to speed up the drying process in this way by using large amounts of a film hardening agent, but development slows down and speed is decreased by the increased hardness of the film. In addition, covering power is reduced, the fixing rate of the undeveloped silver halide grains is reduced, residual coloration is deteriorated and a large amount of hypo is retained in the sensitive material after processing. On the other hand, reduction of the water content of the sensitive material prior to the commencement of drying can be achieved by reducing the amounts of the hydrophilic materials (e.g., gelatin, synthetic polymers, and hydrophilic low molecular weight substances, etc.) which are coated on the sensitive material. Hydrophilic low molecular weight substances are generally added to prevent dry fogging of the silver halide grains during the coating process and the sensitive material is inevitably fogged if these agents are omitted. On the other hand, if gelatin and synthetic polymeric materials which are used as binders for the silver halide grains are omitted, the amount of binder with respect to silver halide grains is reduced and there is an increase in silver content. Reduction in the amount of binder can also lead to a worsening of graininess and variations in speed as a result of flexing and scuffing during the handling of the sensitive material prior to development processing are liable to occur. Thus, even though the drying properties are improved, it is not really possible to reduce the amount of binder because of these problems. Against this background, the provision of a technique which enables a sufficiently high speed to be achieved with a short processing time, which provides excellent mixing and water washing properties, with which there is little residual coloration, and with which drying can be achieved in a short period of time is clearly desirable.

A method in which organic material (for example, gelatin, matting agent, plasticizer, synthetic polymeric material or some other organic substance) which has been coated in the emulsion layer or other hydrophilic layer is washed out in an amount of at least 10% of the total coated weight prior to processing during the course of development, fixing, water washing and drying when the sensitive material is being processed in an automatic development machine, as disclosed in JP-A No. 63-68837 has been developed as a means of resolving these problems with development processing in automatic development machine.

It is thus possible with this method to obtain pictures which have an excellent high covering power while still having a sufficiently rapid drying rate.

However, new problems arise when the method in which large amounts of organic material are washed out into the processing baths during development processing is used conjointly with the antistatic techniques described earlier. This is because the nonionic surfactants which are used as antistatic agents in the sensitive material are washed out in large amounts into the development bath as the organic material is being washed out. Process contamination thus arises with the formation of insoluble material in the development and fixing baths, for example. The bath contaminants accumulate when large amounts of sensitive material are being processed and they adhere to the sensitive material, giving rise to development failure and fixing failure. This has a marked adverse effect on picture quality.

Methods in which use is made of polyoxyethylenebased nonionic surfactants, anionic surfactants which contain polyoxyethylene groups and fluorine-containing anionic surfactants which contain polyoxyethylene groups as disclosed in the aforementioned JP-A Nos. 60-76741 and 60-76742 have been used as a means of overcoming this problem, but it has not been possible to provide simultaneously both excellent antistatic properties and improvement in respect of processing bath contamination (especially fixing bath contamination) even when these techniques are employed.

SUMMARY OF THE INVENTION

Thus, a first objective of the present invention is to provide a photographic material which has a sufficiently rapid drying rate and which also retains high covering power; achieves a high speed with a short processing time; has little residual coloration in cases where dye sensitization has been used; and has antistatic properties. A method for the development processing of such materials is also provided.

A second objective of the present invention is to provide a sensitive material which has a sufficiently rapid drying rate while not contaminating the development processing baths, and which has antistatic properties.

The above identified objectives of the present invention have been realized by a silver halide photographic material comprising a support having thereon at least one light-sensitive silver halide emulsion layer and at least one other hydrophilic colloid layer, wherein at least one compound represented by formula (I) is contained in at least one layer of the silver halide photographic material and wherein an organic material is contained in at least one of light-sensitive silver halide emulsion layer and other hydrophilic colloid layer such that at least 10% by weight of the organic material originally present in the layers of the silver halide photographic material is washed out from the layer during development processing.

The compound of formula (I) is represented as:

$$A—X—Y—B \qquad (I)$$

wherein A represents an alkyl group having from 8 to 25 carbon atoms, an alkenyl group having from 8 to 25 carbon atoms or an aryl group having from 8 to 25 carbon atoms; X represents $$—O—,\ —\underset{\underset{O}{\|}}{C}O—,\ —S—,\ —\underset{\underset{R}{|}}{N}—,\ —\underset{\underset{R}{|}}{C}ON—,\ \text{or}\ —SO_2\underset{\underset{R}{|}}{N}—;$$

wherein R represents an alkyl group having from 1 to 10 carbon atoms or —Y—B; Y represents a group consisting of at least one of the unit $$\left(CH_2—CH_2O\right)_a \text{ and } \left(CH_2\underset{\underset{OH}{|}}{C}HCH_2O\right)_b$$

wherein a represents from 5 to 50 and b represents from 2 to 20; B represents hydrogen or an alkyl group having not more than 8 carbon atoms, an alkylcarbonyl group having not more than 8 carbon atoms or a phenyl group having not more than 8 carbon atoms.

Furthermore, the alkyl groups, alkenyl groups, aryl groups, phenyl groups and alkylcarbonyl groups represented by A, R, or B in formula (I) may have substituent groups, Preferred substituent groups include halogen atoms and hydroxyl groups.

Preferred examples of the groups represented by A include:

$C_8H_{17}$—, $C_{16}H_{33}$—, $C_6H_{13}\underset{\underset{C_8H_{17}}{|}}{C}HCH_2$—, -continued

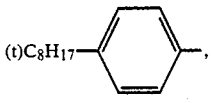

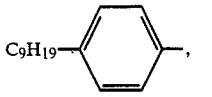

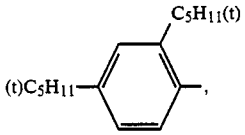

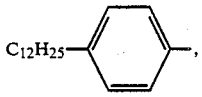

$C_{11}H_{23}CONHCH_2CH_2$—,

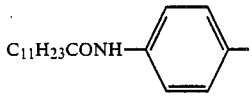

, etc.

Preferred examples of the groups represented by Y include:

$$\left(CH_2CH_2O\right)_{10},$$

$$\left(CH_2\underset{\underset{OH}{|}}{C}HCH_2O\right)_3,$$

$$\left(CH_2CHO\right)_{10}\left(CH_2\underset{\underset{OH}{|}}{C}HCH_2O\right)_5\left(CH_2CH_2O\right)_{10},$$

$$\left(CH_2\underset{\underset{OH}{|}}{C}HCH_2O\right)_3\left(CH_2CH_2O\right)_{10},$$

$$\left(CH_2\underset{\underset{OH}{|}}{C}HCH_2O\right)_3\left(CH_2CH_2O\right)_{20}\left(CH_2\underset{\underset{OH}{|}}{C}HCH_2O\right)_3, \text{ etc.}$$

In a and b, preferred a represents an integer of from 5 to 20 and preferred b represents an integer of from 2 to 10.

Preferred examples of the groups represented by B include:

H, $C_4H_9$—,

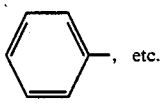

, etc.

Examples of compounds which can be represented by formula (1) which can be used in the present invention are indicated below.

$$C_8H_{17}O\left(CH_2CH_2O\right)_5\left(CH_2\underset{\underset{OH}{|}}{C}HCH_2O\right)_2H \qquad 1$$

-continued
2 $C_{16}H_{33}O(CH_2CH_2O)_{10}(CH_2\underset{\underset{OH}{|}}{C}HCH_2O)_{3}H$
3 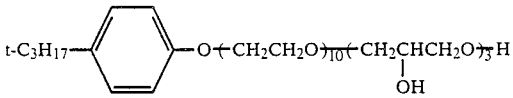
4 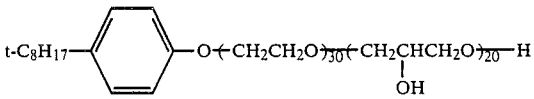
5 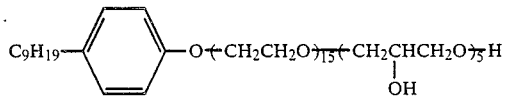
6 $C_6H_{13}\underset{\underset{C_8H_{17}}{|}}{C}HCH_2O(CH_2CH_2O)_{10}(CH_2\underset{\underset{OH}{|}}{C}HCH_2O)_{3}H$
7 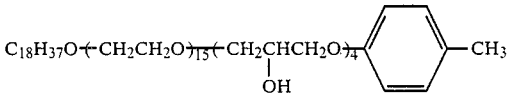
8 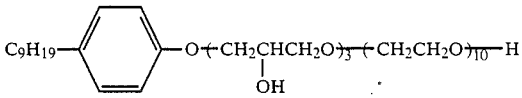
9 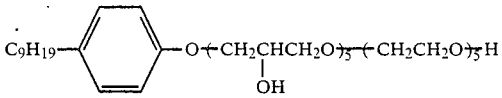
10 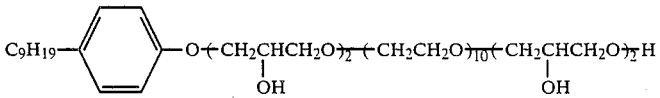
11 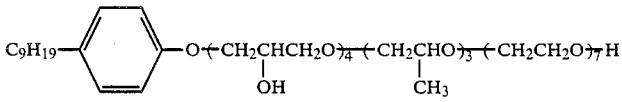
12 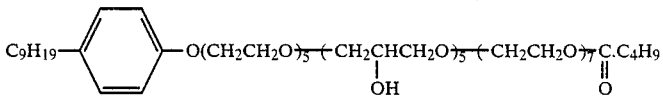
13 $C_{15}H_{31}COO(CH_2CH_2O)_{12}(CH_2\underset{\underset{OH}{|}}{C}HCH_2O)_{4}H$
14 $C_{15}H_{31}COO(CH_2\underset{\underset{OH}{|}}{C}HCH_2O)_{5}(CH_2CH_2O)_{10}H$
15 $C_{15}H_{31}COO(CH_2CH_2O)_{7}(CH_2\underset{\underset{OH}{|}}{C}HCH_2O)_{7}(CH_2CH_2O)_{7}C_8H_{17}$
16 $C_{12}H_{25}-S-(CH_2CH_2O)_{10}(CH_2\underset{\underset{OH}{|}}{C}HCH_2O)_{5}H$ -continued

17

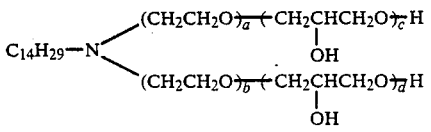

a + b = 15 c + d = 5

18

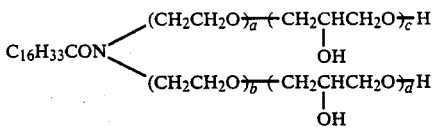

a + b = 20 c + d = 10

19

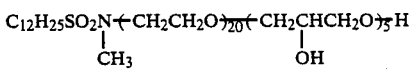

20

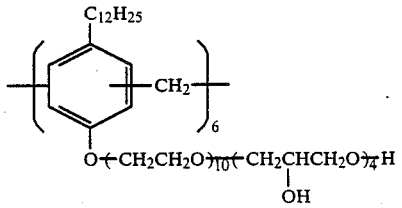

21

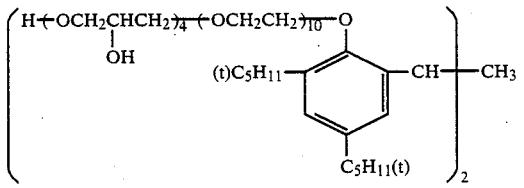

22

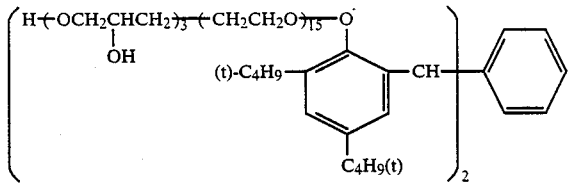

Compounds which can be represented by formula (I) have an ethylene oxide group (average additional molar values of at least 5 mol) and a molar glycidol group in the same molecule. An average number weighted by mol of at least 5 of ethylene oxide groups must be attached to such compounds to provide adequate antistatic properties (surface resistance reducing capacity).

Furthermore, it has been discovered that the glycidol groups have the effect of markedly and specifically increasing the solubility of these compounds in photographic processing baths (ionic strength: 2 to 3). It is clear that this solubility is closely related to reduction of process contamination which is an objective of the present application (see Example 1).

Compounds represented by formula (I) can be prepared using conventional methods. An example of the synthesis is described below.

SYNTHESIS EXAMPLE 1

Preparation of Compound 3

The dry compound of which the formula is indicated below (97.0 g, 0.15 mol) and 3.9 g of sodium hydroxide were introduced into a 300 ml capacity flask which had been furnished with a stirrer, a reflux condenser, a thermometer and a dropping funnel. The mixture was heated to 155°-160° C. and stirred.

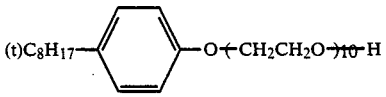

Glycidol (33.3 g, 0.45 mol) was then drip fed into the mixture over a period of about 1.5 hours while maintaining the temperature with the range of 155°-160° C. After addition, the mixture was reacted for an additional 7 hours with stirring. No unreacted glycidol was detected. After cooling, 100 ml of ethanol was added to the mixture to form a solution which was neutralized using concentrated hydrochloric acid.

The solvent was then removed by distillation under reduced pressure, after which 200 ml of toluene was added to form a solution. This solution was heated with active carbon and decolorized, after which the mixture was filtered and the solvent was removed by distillation under reduced pressure. A light yellow viscous solution was obtained. The presence of the target material was confirmed using IR and NMR. (However, some of reaction product of the secondary OH group of the glycidol was included.) The surface tension (1%) was 29 dyn/cm.

In the present invention, the compounds represented by formula (I) can be added as antistatic agents to the hydrophilic organic colloids, or to the organic solvent-based coating solutions for the backing layer of the support.

The compound represented by formula (I) of the present invention is added to at least one of the silver halide emulsion layers or other structural layers of the sensitive material. In the case of addition to a structural layer other than a silver halide emulsion layer, addition to a hydrophilic colloid layer is preferred, such as a surface protective layer, a backing layer, an intermediate layer or an undercoating layer, etc. Preferred addition layer is a surface protective layer or a backing layer.

In cases where the surface protective layer or backing layer consists of two layers, the compounds represented by formula (I) can be added to either layer, or the compounds may be added to a layer overcoated over the surface protective layer.

The amount of the compound represented by formula (I) used in the present invention is preferably from 0.0001 to 2.0 g, and is more preferably from 0.0005 to 0.3 g, per square meter of the sensitive material.

Mixtures of two or more of the compounds represented by formula (I) of the present invention can also be used.

Description of the Organic Material of the Present Invention

In the present invention, the development processing in an automatic developing machine is carried out in such a way that organic material accounting for at least 10% of the total weight of organic material coated prior to processing is washed out during the course of development, fixing, water washing and drying. The washed out organic material may be physically dissolved or it may be removed by means of a chemical reaction. In practice, the organic material is preferably included in the emulsion layers and/or other hydro-philic colloid layers in such a way that it can be washed out in the course of development processing. For example, the organic material can take the form of a water-soluble synthetic or natural polymer. When the organic material is gelatin, it is preferably a type of gelatin which does not undergo a gelatin crosslinking reaction with film hardening agents such as acetylated gelatin or phthalated gelatin, or an alkyl (for example, methyl, ethyl, propyl, benzyl) ester of gelatin, etc. The organic materials washed out which have a low molecular weight are preferred. The molecular weight is preferably not more than 20,000 and most preferably the molecular weight is not more than 10,000.

Furthermore, synthetic water-soluble polymers and natural water-soluble polymers can be used as the organic material of the present invention. Synthetic water-soluble polymers for use in the present invention include those which have a nonionic groups in the molecular structure, those which have anionic groups, and those which have both anionic and nonionic groups. Examples of nonionic groups include an ether group, an ethylene oxide group and a hydroxyl group, and examples of anionic groups include a sulfonic acid group and salts thereof, a carboxylic acid group and salts thereof, and a phosphoric acid group and salts thereof. Natural water-soluble polymers for use as then organic material of the present invention include those which have nonionic groups within the molecular structure, those which have anionic groups and those which have both nonionic groups and anionic groups.

Synthetic and the natural water-soluble polymers which have anionic groups or both anionic groups and nonionic groups are preferred for use as the organic material of the present invention. According to the present invention, the water-soluble polymer has a solubility of preferably at least 0.05 g, and more preferably at least 0.1 g, in 100 g of water at 20° C. Moreover, the water-soluble polymers of the present invention preferably have a high solubility in development baths and fixing baths, and the solubility of the water-soluble polymers is generally at least 0.05 g, preferably at least 0.5 g, and most desirably at least 1 g, per 100 g of the development bath or the fixing bath.

Polymers which contain from 10 mol % to 100 mol % of a repeating unit as represented by formula (P) indicated below can be used as the synthetic water-soluble polymer organic materials of the present invention.

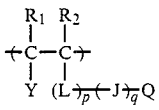

(P)

wherein $R_1$ and $R_2$ may be the same or different, each representing a hydrogen atom, an unsubstituted or substituted alkyl group, preferably an alkyl group which has from 1 to 4 carbon atoms (including those which have substituent groups such as methyl, ethyl, propyl, buty), a halogen atom (for example, chlorine), or a —$CH_2COOM$ group. L represents a —CONH—group, an —NHCO—group, a —COO—group, a —OCO—group, a —CO—group or an —O—group. J represents an unsubstituted or substituted alkylene group, preferably an alkylene group which has from 1 to 10 carbon atoms (including substituted alkylene groups, such as methylene, ethylene, propylene, trimethylene, butylene, hexylene), an unsubstituted or substituted arylene group (including substituted arylene groups such as phenylene) or a —$(CH_2CH_2O)_m(CH_2)_n$ group, a

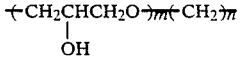

group (wherein m is an integer of from 1 to 40 and n is an integer of from 0 to 4). Q represents

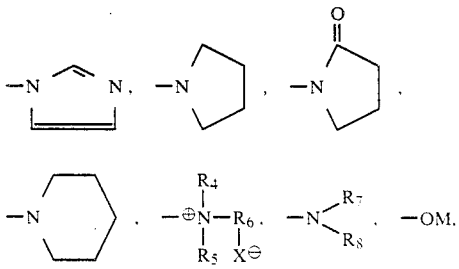

-continued

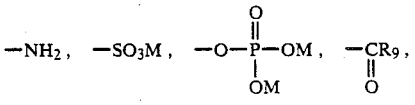

a hydrogen atom or a group represented by R shown below. M represents a hydrogen atom or a cation such as an alkali metal (e.g., $Na^+$, $K^+$, $Li^+$), an alkaline earth metal (e.g., $Ca^{2+}$, $Ba^{2+}$, an ammonium ion and an alkylammonium ion, $R_9$ represents an alkyl group having from 1 to 4 carbon atoms (for example, methyl, ethyl, propyl, butyl). $R_3$, $R_4$, $R_5$, $R_6$, $R_7$ and $R_8$ each represents a hydrogen atom, an alkyl group having from 1 to 20 carbon atoms (for example, methyl, ethyl, propyl, butyl, hexyl, decyl, hexadecyl), an alkenyl group (for example, vinyl, aryl), a phenyl group (for example, phenyl, methoxyphenyl, chlorophenyl), or an aralkyl group (for example, a benzyl), X represents an anion such as a hlaogen atom (e.g., $Cl^-$, $Br^-$, $I^-$), a sulfuric group, and an isocyanic group, and p and q each represents 0 or 1. Particularly preferably, L represents a polymer containing an acrylamide or methacrylamide represented by the formula —CONH. Y represents a hydrogen atom or an $-(L)_p(J)_qQ$ group.

Examples of synthetic water-soluble polymers of formula (P) for use as the organic material of the present invention are listed below.

| | Number average molecular weight Mn |
|---|---|
| P-1 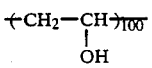 | 8,000 |
| P-2 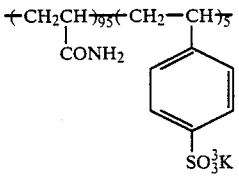 | Mn: 15,000 |
| P-3 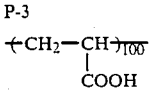 | Mn: 4,800 |
| P-4 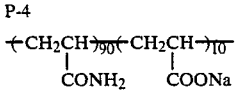 | Mn: 9,000 |
| P-5 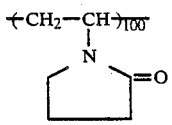 | Mn: 3,100 |
| P-6 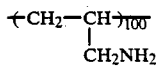 | Mn: 11,000 |
| P-7 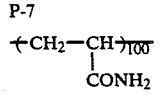 | Mn: 3,000 |
| P-8 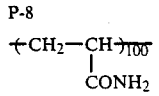 | Mn: 8,000 |
| P-9 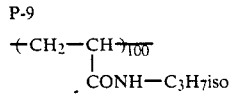 | Mn: 6,000 |
| P-10 | |

-continued
| | Number average molecular weight Mn |
|---|---|
| 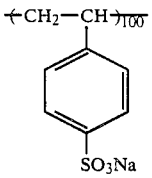 | Mn: 7,800 |
| P-11 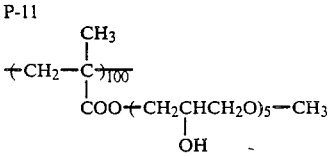 | Mn: 10,000 |
| P-12 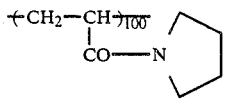 | Mn: 9,500 |
| P-13 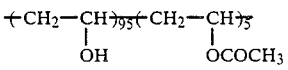 | Mn: 9,000 |
| P-14 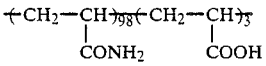 | Mn: 12,000 |
| P-15 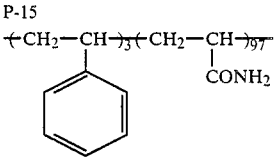 | Mn: 5,300 |
| P-16 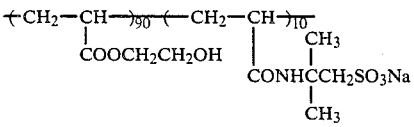 | Mn: 8,000 |
| P-17 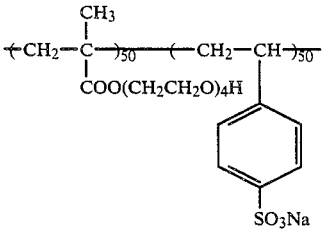 | Mn: 10,500 |
| P-18 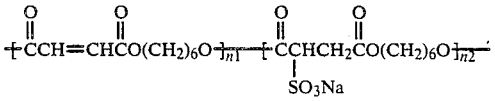 (Here, n1/n2: 50 mol %/50 mol %, Number average molecular weight (Mn): About 10,000) | |
| P-19 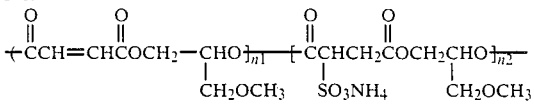 (Here, n1/n2: 75 mol %/75 mol %, Number | |

-continued

| | Number average molecular weight Mn |
|---|---|
| average molecular weight (Mn): About 20,000) | |

These synthetic water-soluble polymers can be prepared by solution polymerization, bulk polymerization, suspension polymerization, etc. For example, in the case of solution polymerization, a mixture consisting of monomers having a suitable concentration in an appropriate solvent (for example, ethanol, methanol, water, etc.); the monomer mixture which is normally present at a concentration of not more than 40 wt % with respect to the solvent, and preferably at a concentration of from 10 to 25 wt %, is copolymerized by heating to a suitable temperature (for example, generally from 40° to 120° C., and preferably from 50° to 100° C.) in the presence of a polymerization initiator (for example, benzoyl peroxide, azobisisobutyronitrile, ammonium persulfate, etc.). Subsequently, the unreacted mixture is separated and removed by pouring the reaction mixture into a medium in which the water-soluble polymer which has been formed will not dissolve. The precipitated polymer product is then dried. The molecular weight of the water-soluble polymer of the present invention is generally within the range from 1,000 to 100,000, and preferably within the range from 2,000 to 20,000.

Natural water-soluble polymers have been described in detail in the *General Technical Data Book of Water-Soluble Polymer Dispersion Type Resins* (published by the Business Development Center), but the use of lignin, starch, pluran, cellulose, alginic acid, dextran, dextrin, guam gum, gum arabic, glycogen, laminaran, lichenin, nigeran, etc., or derivatives thereof is preferred as the organic material of the present invention.

Furthermore, the preferred derivatives of natural water-soluble polymers include those which have been sulfonated, carboxylated, phosphated, sulfoalkylated or carboxyalkylenated or alkylphosphated, and the salts thereof, and those which have been polyoxyalkylenated (for example, with ethylene, glycerin, propylene, etc.), and those which have been alkylated (for example, with methylated, ethylated, benzylated, etc.).

Two or more natural water-soluble polymers can also be used conjointly in the present invention.

Furthermore, among the natural water-soluble polymers, glucose polymers and derivatives thereof are preferred for use as organic materials of the present invention. Among the glucose polymers and derivatives thereof, the use of starch, glycogen, cellulose, lichenin, dextran and nigeran, etc., is preferred, and the use of dextran and derivatives thereof is most preferred.

Dextran is a D-glucose polymer which has α-1,6 bonding, and it is normally obtained by culturing dextran producing bacteria in the presence of sugars. Dextran can also be obtained by contacting sugars and dextran sucrase which have been isolated from the culture media of dextran producing bacteria such as leuconostoc, mesenteroides, etc. These native dextrans can be treated with acid or alkali enzymes and partially depolymerized to reduce the molecular weight to the prescribed level. Materials which have a limiting viscosity in the range from 0.03 to 2.5 can be obtained in this way.

Furthermore, examples of modified dextrans include dextran sulfate ester, carboxyalkyldextrans, hydroxyhydroxyalkyldextrans, etc. The molecular weights of these natural water-soluble polymers for use in the present invention are preferably within the range from 1,000 to 100,000, and most preferably it is within the range from 2,000 to 50,000.

The amount of synthetic or natural water-soluble polymer of the present invention included in the sensitive material is at least 10 wt % of the total weight of the sensitive material, and preferably is from 10 wt % to 30 wt % with respect to total weight.

The amount of the organic material of the present invention washed out during processing is at least 10 wt %, preferably from 10 to 50 wt %, and more preferably from 15 to 30 wt %, of the total weight of the coated organic material other than the silver halide grains.

Other structural features of the sensitive materials of the present invention are described below.

The binders which are normally used to form sensitive materials can be used as the binder polymers which form the pictures, remaining on the support after processing, in the present invention. For example, the use of crosslinkable gelatins having average molecular weight of from 70,000 to 100,000 (both lime-treated and acid-treated gelatins can be used), and polyacrylamide, polyvinyl alcohol, polyvinyl pyrrolidone, dextran and derivatives thereof disclosed in U.S. Pat. No. 3,514,289 are preferred. Here, polymers other than gelatin can be added as well as the organic substances (water-soluble polymers) of the present invention in order to raise the covering power of the silver halide. A wide molecular weight distribution of the water-soluble polymers used for the purpose of the present invention can be used and the construction can be such that the high molecular weight component is left behind or the low molecular weight component which is not washed out is left behind.

The amount of residual binder is preferably from $\frac{1}{3}$ to 3 times, and most desirably from $\frac{1}{2}$ to 2 times, by weight of the weight of coated silver. It is preferable that from 50 wt % to 90 wt %, and particularly from 65 wt % to 80 wt %, of the binder which is present in the sensitive material prior to development processing is gelatin.

The amount of residual binder is generally from 1.5 to 6 g per square meter, and preferably from 2 to 4 g per square meter, per side.

Residual binder hardened with various crosslinking agents is generally not washed out by development processing. Various materials can be used as crosslinking agents and the hardening agents generally known in the industry can be used for this purpose. Furthermore, the use of 2,4-dichloro-6-hydroxy-1,3,5-triazine, or compounds which have active vinyl groups, or halo-substituted formamidinium salts, or carbamoylammonium salts is preferred as the hardening agent when the residual binder consists of gelatin.

The compounds disclosed, for example, in JP-A Nos. 53-41221, 53-57257, 51-126124, JP-B No. 49-13563, JP-A Nos. 51-44164, 52-21059, U.S. Pat. Nos. 3,490,911 and 3,539,644, JP-B No. 50-35807, JP-A Nos. 54-30022, 53-66960, JP-B Nos. 52-46495, 47-8736, U.S. Pat. Nos. 3,635,718 and 3,040,720, and West German Pat. No. 872,153 can be used as compounds which have active vinyl groups.

The compounds disclosed, for example, in JP-A Nos. 60-225148 and 61-240236 can be used as compounds which have halo-substituted formamidinium groups.

The compounds disclosed, for example, in JP-A No. 56-12853 and JP-B No. 58-32699 can be used as compounds which have a carbamoylammonium group.

Moreover, polymeric film hardening agents can be used effectively as the gelatin hardening agents which are used in the invention, and the polymeric film hardening agents disclosed in JP-A No. 60-61742 have an especially desirable effect.

Film hardening of the present invention is carried out using these film hardening agents. The extent of swelling in water (21° C., 3 minutes) as described in U.S. Pat. No. 4,414,304 is preferably not more than 300%, and most preferably it is not more than 200%.

Silver chloride, silver chlorobromide silver bromide, silver iodobromide and silver chloroiodobromide can be used in the photosensitive silver halide emulsions of the present invention, but the use of silver bromide or silver iodobromide, especially those which contain from 0 mol % to 3.5 mol % of iodide, are preferred with respect to achieving a high speed. The use of silver iodobromides with a structure having an internal phase with a high iodide content is especially desirable.

Compounds which release inhibitors during the course of development, as disclosed in JP-A Nos. 61-230135 and 63-25653, can be used conjointly.

The amount of silver coated on a sensitive material of the present invention is generally from 1.0 to 6.0 g per square meter, and preferably from 1.5 to 4 g per square meter, per side of the support in the case of medical camera sensitive materials, and preferably from 6 to 15 g per square meter per side in the case of industrial X-ray sensitive materials.

The average diameter of spheres having a volume equivalent to the grains is preferably at least 0.3 μm. Most preferably, the average sphere diameter is from 0.3 to 2.0 μm. The grain size distribution may be wide or narrow.

The silver halide grains in the emulsion may have a regular crystal form, such as a cubic or octahedral form, or they may have an irregular crystal form such as a spherical, tabular or pebble-like form, or they may have a composite form consisting of such forms. Mixtures of grains which have various crystal forms can be used.

The use of tabular silver halide grains in the present invention is especially effective.

Methods well known in the industry can be used in the appropriate manner for the manufacture of tabular silver halide grains.

Tabular silver halide grains are easily manufactured with reference to the methods disclosed in JP-A Nos. 58-127921, 58-113927, 58-113928, and U.S. Pat. No. 4,439,520.

The use in the present invention of the tabular grain emulsions in which the average aspect ratio of the grains as defined in column 12 of U.S. Pat. No. 4,439,520 is preferably at least 3, and more preferably within the range from 4 to 8, is preferred.

Moreover, among the tabular silver halide grains which can be used in the present invention, monodisperse hexagonal tabular grains are especially preferred.

Details of the structure of monodisperse hexagonal tabular grains and a method for their manufacture have been disclosed in JP-A No. 63-151618.

Furthermore, the silver halide grains which are used in the present invention may take the form of a core/shell type shallow internal latent image type emulsion in which the hexagonal tabular grains form the cores.

Furthermore, the silver halide grains used in the present invention may be grains in which guest grains of various halogen compositions have been grown epitaxially using the hexagonal tabular grains as host grains.

The hexagonal tabular grains used in the present invention may be grains which have a transition line within the grains.

Various compounds can be included in the photographic emulsions used in the present invention with respect to preventing the occurrence of fogging during the manufacture, storage or photographic processing of the sensitive material, or with respect to stabilizing the photographic performance of the sensitive material. Thus, many compounds which are known as antifogging agents or stabilizers, such as azoles, for example, benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially, 1-phenyl-5-mercaptotetrazole), etc.; mercaptopyrimidines; mercaptotriazines; thioketones, such as oxazolinethione; azaindenes, for example, triazaindenes, tetraazaindenes (especially, 4-hydroxy-substituted (1,3,3a,7)tetraazaindenes), pentaazaindenes, etc.; benzenethiosulfonic acid, benzenesulfinic acid, benzenesulfonic acid amide, etc., can be added for this purpose. Those disclosed, for example, in U.S. Pat. Nos. 3,954,474 and 3,982,947, and in JP-B No. 52-28660 can be used for this purpose.

The silver halide grains used in the present invention may be spectrally sensitized by means of sensitizing dyes.

The dyes which can be used for this purpose include cyanine dyes, merocyanine dyes, complex cyanine dyes, complex merocyanine dyes, holopolar cyanine dyes, hemicyanine dyes, styryl dyes and hemioxonol dyes. The most useful dyes are those selected from among the cyanine dyes, the merocyanine dyes and the complex merocyanine dyes. Any nuclei normally used in cyanine dyes can be used as the basic heterocyclic nucleus in these dyes. Those nuclei include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus and a pyridine nucleus, etc., nuclei in which these nuclei are fused with aliphatic hydrocarbon rings, and nuclei in which these nuclei are fused with aromatic hydrocarbon rings, which is to say, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc. These nuclei may be substituted on the carbon atoms.

5- or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus and a thiobarbituric acid nucleus, etc., can be used as the nuclei having a ketomethylene structure in merocyanine dyes or in complex merocyanine dyes.

In practice, those disclosed in *Research Disclosure*, Vol. 176, No. 17643 (December, 1978), page 23, and in U.S. Pat. Nos. 4,425,425 and 4,425,426 can be used.

These sensitizing dyes may be used individually or they may be used in combinations, and combinations of sensitizing dyes are often used in order to achieve supersensitization.

Dyes which themselves have no spectral sensitizing action or substances which have essentially no absorbance in the visible region but which exhibit supersensitizing properties can be included in the emulsion along with the sensitizing dyes. For example, aminostilbene compounds substituted with a nitrogen-containing heterocyclic group (for example, those disclosed in U.S. Pat. Nos. 2,933,390 and 3,635,721), aromatic organic acid-formaldehyde condensates (for example, those disclosed in U.S. Pat. No. 3,743,510), cadmium salts, and azaindene compounds, etc., may be included. The combinations disclosed in U.S. Pat. Nos. 3,615,613, 3,615,641, 3,617,295 and 3,635,721 are especially useful.

The sensitizing dyes used in the present invention are generally added before coating the emulsion onto a suitable support, but the addition can be made during the chemical ripening process or during the process in which the silver halide grains are being formed.

Plasticizers such as polymers or emulsions can also be included in the emulsion layers of the sensitive materials of the present invention in order to improve their pressure characteristics.

For example, methods in which heterocyclic compounds are used have been disclosed in British Pat. No. 738,618. Methods in which alkyl phthalates are used have been disclosed in British Pat. No. 738,637. Methods in which alkyl esters are used have been disclosed in British Pat. No. 38,639. Methods in which polyhydric alcohols are used have been disclosed in U.S. Pat. No. 2,960,404. Methods in which carboxyalkyl cellulose has been used have been disclosed in U.S. Pat. No. 3,121,060. Methods in which paraffins and carboxylic acid salts are used have been disclosed in JP-A No. 49-5017. Methods in which alkyl acrylates are used have been disclosed in JP-B No. 53-28086.

Polymer latexes known in the industry, such as homopolymers or copolymers of alkyl acrylates and copolymers of vinylidene chloride, can be included in the hydrophilic colloid layers of the sensitive materials of the present invention. These polymer latexes may be prestabilized with nonionic surfactants as disclosed in JP-A No. 61-230136.

An antihalation layer can be established on the support used in the present invention. Carbon black or various dyes, for example, oxonol dyes, azo dyes, arylidene dyes, styryl dyes, anthraquinone dyes, merocyanine dyes and tri-(or di-)allylmethane dyes, etc., can be used for this purpose. A cationic polymer or latex can also be used so that the dye is not diffused from the antihalation layer.

Furthermore, magenta dyes as disclosed in JP-A No. 61-285445 can be used in order to improve the tone of the silver image.

Matting agents consisting of colloidal silica or barium strontium silicate, poly(methyl methacrylate), methyl methacrylate/methacrylic acid copolymer, methyl methacrylate/styrene sulfonic acid copolymers disclosed in Japanese Patent Application No. 62-50684 or the particles which contain fluorine groups disclosed in JP-A No. 61-230126 can be used in the hydrophilic colloid layers of the present invention. Moreover, the use of matting agents which have functional groups which can react with gelatin as disclosed in Japanese Patent Application No. 62-175485 is preferred.

The particle size of these matting agents is preferably from 0.5 to 10 μm, and most desirably from 1 to 6 μm.

Various surfactants can be included in the photographic emulsion layers or other hydrophilic colloid layers of the sensitive materials of the present invention. These surfactants may serve a variety of purposes including use as coating aids on antistatic agents, for the improvement of sliding properties, for emulsification and dispersion purposes, for the prevention of adhesion, and for the improvement of photographic performance (for example, for accelerating development, increasing contrast and sensitization), etc.

For example, nonionic surfactants may be used, including saponin (steroid-based), alkylene oxide derivatives (for example, poly(ethylene glycol), poly(ethylene glycol)/poly(propylene glycol) condensates, poly(ethylene glycol) alkyl ethers or poly(ethylene glycol) alkyl aryl ethers, poly(ethylene glycol) esters, poly(ethylene glycol) sorbitan esters, poly(alkylene glycol) alkyl amines or amides, poly(ethylene oxide) adducts of silicones), fatty acid esters of polyhydric alcohols, alkyl esters of sugars, etc.; anionic surfactants which contain carboxyl groups, sulfo groups, phospho groups, sulfate ester groups, phosphate ester groups, etc., such as alkyl carboxylates, alkyl sulfonates, alkylbenzenesulfonates, alkylnaphthalenesulfonates, alkylsulfate esters, alkyl phosphate esters, N-acyl-N-alkyltaurines, sulfosuccinate esters, sulfoalkylpolyoxyethylene alkylphenyl ethers, polyoxyethylene-alkyl phosphate esters, etc.; amphoteric surfactants such as amino acids, aminoalkylsulfonic acids, aminoalkylsulfate or phosphate esters, alkyl betaines, amine oxides, etc.; and cationic surfactants such as alkylamine salts, aliphatic or aromatic quaternary ammonium salts, heterocyclic quaternary ammonium salts such as pyridinium or imidazolium, etc., and aliphatic group or heterocyclic ring-containing phosphonium or sulfonium salts.

These have been described by R. Oda in *Surfactants and Their Applications* (published by Maki Shoten, 1964), by H. Horiguchi in *New Surfactants* (published by Sankyo Shuppan (Co.), 1975), in Mc Cutcheons Detergents and Emulsifiers (Mc Cutcheon Divisions, MC Publishing Co., 1985), in JP-A Nos. 60-76741, 62-172343, 62-173456 and 62-215272, etc.

The fluorine-containing surfactants or polymers disclosed in JP-A Nos. 62-9044 and 62-215272, the nonionic surfactants disclosed in JP-A Nos. 60-76742, 60-80846, 60-80848, 60-80839, 60-76741, 58-208743, 62-172343, 62-173456 and 62-215272, etc., and/or the electrically conductive polymers or latexes (nonionic, anionic, cationic, amphoteric) disclosed in JP-A Nos. 57-204540 and 62-215272 are preferably used as antistatic agents. Furthermore, the use of ammonium, alkali metal or alkaline earth metal halides, nitrates, perchlorates, sulfates, acetates, phosphates, thiocyanates, etc., the electrically conductive tin and zinc oxides and the complex oxides obtained by doping these metal oxides with antimony, etc., disclosed in JP-A No. 57-118242, etc., as inorganic-based antistatic agents is preferred. Moreover, various charge transfer complexes, polymers which have conjugated $\pi$ systems and doped varieties thereof, organic metal compounds and interlayer compounds, etc., can also be used as antistatic agents. Examples include TCNQ/TTF, polyacetylene and polypyrrole, etc. These have been described by Morita et al., *Kagaku to Kogyo* (*Science and Industry*), Vol. 59, No. 3, pages 103 to 111 (1985) and Vol. 59, No. 4, pages 146 to 152 (1985).

The photosensitive materials of the present invention may also have intermediate layers, filter layers, antihalation layers, etc., if desired.

The photographic emulsion layers and other layers in the sensitive materials of the present invention are coated on a flexible support such as a plastic film. Films consisting of semisynthetic or synthetic polymers such as cellulose nitrate, cellulose acetate, cellulose acetate butyrate, polystyrene, poly(vinyl chloride), polyethylene terephthalate, polycarbonate, etc., are useful as flexible supports. The support may be colored by using dyes or pigments.

Structures in which there is at least one silver halide emulsion layer on both sides of the support, as disclosed in JP-A Nos. 58-127921, 59-90841, 58-111934, 61-201235, etc., are preferred.

No particular limitation is imposed upon the method used to coat the emulsion layers, surface protective layers, etc., on the support in the present invention, but the use of the multilayer simultaneous coating methods disclosed, for example, in U.S. Pat. Nos. 2,761,418, 3,508,947 and 2,761,791, etc., is preferred.

Polymers which provide cationic sites can be included in the fixing bath for the present invention, and dyes can be added. Dye mordant polymers can also be used.

Conventional developing agents can be included in the development baths used in the present invention. Thus, dihydroxybenzenes (for example, hydroquinone), 3-pyrazolidones (for example, 1-phenyl-3-pyrazolidone) and aminophenols (for example, N-methyl-p-aminophenol), etc., can be used either independently or in combination as developing agents. Furthermore, known preservatives, alkalis, pH buffers, antifogging agents, etc., are generally included in the development bath, and dissolution aids, toners, development accelerators (for example, quaternary salts, hydrazine, benzyl alcohol), surfactants, antifoaming agents, hard water softeners, film hardening agents (for example, glutaraldehyde), tackifiers, etc., may be included, if desired.

Commonly used fixer compositions can be used according to the present invention. Organic sulfur compounds which are known to be effective as fixing agents can be used as the fixing agent as well as thiosulfates and thiocyanates. Water-soluble ammonium salts can also be included in the fixing baths as film hardening agents.

The use of roller transport type automatic development processors as disclosed in U.S. Pat. Nos. 3,025,779, 3,515,556, 3,573,914 and 3,647,459, and in British Pat. No. 1,269,268 is preferred for development processing with an automatic development processor in the present invention.

The development temperature according to the present invention is preferably from 18° to 50° C., and more preferably from 30° to 45° C. The development time is preferably from 8 to 40 seconds, and more preferably from 8 to 25 seconds.

The complete development processing operation from the start of development through fixing, water washing and the completion of drying is preferably from 30 to 200 seconds, and more preferably from 40 to 100 seconds.

Tabular silver halide photographic materials of the present invention particularly preferably swell by not more than 250% in water (21° C., 3 minutes).

No particular limitations are imposed on the various additives, the method of development, or the method of exposing the photosensitive materials of the present invention. Reference can be made to the disclosures in *Research Disclosure,* Vol. 176, Item 17643 (December, 1978) and *Research Disclosure,* Vol. 184, Item 18431 (August, 1979).

EXAMPLE 1

1-1 Preparation of an Emulsion Coating Solution

Pebble-like silver iodobromide grains (silver iodide content: 3 mol %) were formed in gelatin solution in the presence of ammonia using the double jet method (average grain size: 0.98 μm), and these grains were chemically sensitized with chloroaurate and sodium thiosulfate. After chemical sensitization, the antifogging agent 4-hydroxy-6-methyl-1,3,3a,7-tetraazaindene was added, and Sensitizing Dye (II) indicated below was added in an amount of 200 mg per mol of silver halide grains and an ortho sensitization was carried out.

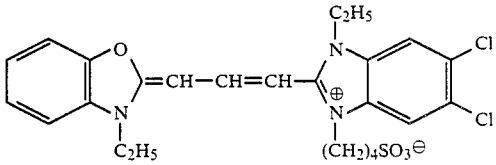

(II)

Moreover, p-octylphenoxyethoxyethoxyethane sulfonic acid sodium salt as coating aid, poly(potassium-p-styrenesulfonate) as tackifier and trimethylolpropane were added to complete the basic formulation of the emulsion layer. The silver/gelatin ratio by weight at this step was 1.35.

1-2 Preparation of the Emulsion Side Protective Layer Coating Solutions

The gelatin solutions indicated below were prepared as protective layer coating solution.

| | Content |
|---|---|
| Acid-treated gelatin | As shown in Table 1-(1) |
| Poly(sodium acrylate) (molecular weight: 400,000) | 0.02 g/m$^2$ |
| Poly(potassium styrenesulfonate) (molecular weight: 600,000) | 0.015 g/m$^2$ |
| Poly(methyl methacrylate) (average particle size: 3.5 μm) | 0.025 g/m$^2$ |
| Poly(methyl methacrylate/methacrylate) (mol ratio: 70/30, average particle size: 2.5 μm) | 0.020 g/m$^2$ |
| p-t-Octylphenoxydiglycerylbutylsulfone compound, sodium salt | 0.02 g/m$^2$ |
| Poly(degree of polymerization: 10)-oxyethylene cetyl ether | 0.035 g/m$^2$ |
| Poly(degree of polymerization: 10)-oxyethylene-poly(degree of polymerization: 3)oxyglyceryl-p-octylphenoxy ether | 0.01 g/m$^2$ |
| 1,2-Bis(vinylsulfonylacetamido)ethane | 0.15 g/m$^2$ |
| Fluorine-containing compounds: | |
| $C_8F_{17}SO_3K$ | 0.003 g/m$^2$ |
| $C_8F_{17}SO_2N(C_3H_7)(CH_2CH_2O)_4(CH_2)_4SO_3Na$ | 0.001 g/m$^2$ |
| $C_8F_{17}SO_2N(C_3H_7)(CH_2CH_2O)_{10}(CH_2CH(OH)CH_2O)_4H$ | 0.003 g/m$^2$ |
| Compound of the present invention | Shown in Table 1-(1) |
| Water-soluble polymer | Shown in |

-continued

| | Content |
|---|---|
| | Table 1-(1) |

1-3 Preparation of the Photographic Film

Gelatin and the water-soluble polymers were added in the proportions shown in Table 1-(1) to the aforementioned emulsion layer and surface protective layer coating solutions. Photographic Materials 1 to 11 were prepared by coating these two layers simultaneously onto an undercoated polyethylene terephthalate support. The coated layers were then dried.

Silver was coated 2.5 g per square meter per side on both sides of the support.

1-4 Measurement of the Amount of Wash Out during Processing

The method described below was used to measure the percentage (by weight) of the organic material coated prior to processing which was washed out during the course of development, fixing, water washing and drying. Thus, samples were left to stand at 25° C. and 10% relative humidity until the water content of samples was in equilibrium with the atmosphere. The weight of each sample was then measured. Next, the samples were processed from development to dry in an automatic developing machine, after which they were again left to stand at 25° C. and 10% relative humidity until the water content reached equilibrium and the samples were then weighed. The weight of the support had been measured beforehand and it had been confirmed that there was no change in the weight of the support when it alone was processed. The developed silver fraction with an even and complete exposure was measured. The weight loss due to development and fixing of the silver halide grains themselves was obtained from the developed silver fraction and the specific gravity of the silver halide. The weight of organic material washed out by the processing operation was also thus determined. The emulsions also contained inorganic salts, but the amounts of inorganic salts involved were such that they could be disregarded when compared to the amount of organic material washed out. Here, the amount of organic material washed out was obtained gravimetrically, but the value could also be determined by measuring the film thickness before and after processing, or the amount of material washed out could also be determined by analyzing the processing baths.

1-5 Method of Measuring the Drying Rate

A "Fuji X-Ray Processor FPM4000" made by the Fuji Photo Film Co., Ltd. was used as the automatic development machine. The compositions of the development and fixing baths used are indicated below.

| Development Bath | |
|---|---|
| 1-Phenyl-3-pyrazolidone | 1.5 g |
| Hydroquinone | 30 g |
| 5-Nitroindazole | 0.25 g |
| Potassium Bromide | 3.0 g |
| Anhydrous Sodium Sulfite | 50 g |
| Sodium Hydroxide | 30 g |
| Boric Acid | 10 g |

-continued

| | |
|---|---|
| Glutaraldehyde | 5 g |
| Water to make | 1 liter |
| pH adjusted to 10.20 | |
| Fixing Bath | |
| Ammonium Thiosulfate | 200.0 g |
| Sodium Sulfite (anhydrous) | 20.0 g |
| Boric Acid | 8.0 g |
| Ethylenediaminetetraacetic Acid Disodium Salt | 0.1 g |
| Ammonium Sulfate | 15.0 g |
| Sulfuric Acid | 2.0 g |
| Glacial Acetic Acid | 22.0 g |
| Water to make | 1.0 liter |
| pH adjusted to 4.20 | |

The samples were developed, fixed and water washed using the development baths and fixing baths described above in the FPM4000 Processor. Afterwards, the samples were squeegeed and the film was taken out immediately before entering the drying zone, whereupon measurements were made in the way indicated below (at this time the blow drier of the FPM4000 had been switched OFF). The film which had been thus processed was blown with a commercial hot blow drier and the time taken for the surface temperature of the film to reach 30° C. was measured using a surface thermometer. The development temperature was 35° C. and the water washing temperature was 14° C.

1-6 Measurement of Dmax

Processing was carried out with the aforementioned development baths and with the drying zone in the automatic development processor operating normally. Exposures were made using white light. The highest density achieved, Dmax was the density value in the state where no increase in density occurred on adequate white light exposure.

1-7 Evaluation of Static Marks

The moisture content of the sample films was adjusted to its equilibrium value by placing the sample films under conditions of 25° C. and 10% relative humidity for 3 hours. The sample films were then passed at high speed (transporting speed of 300 meters per minute) under the above conditions between two pairs of rotating nylon rollers or urethane rollers and then processed in the aforementioned automatic development processor. The state of static marking observed after processing was evaluated on a four step scale ranging from A to D. The assessment stages are as follows:

A: No static mark was observed.
B: Slight static marks were observed.
C: Considerable static marks were observed.
D: Static marks were observed over the whole surface.

1-8 Fixing Bath Contamination Test (One thousand samples (measuring 25 cm×30 cm) which were X-ray exposed to provide a Dmax of 1.2 were processed continuously in the aforementioned FPM4000 Processor and the extent of precipitation in the fixing bath was evaluated in accordance with the four stages indicated below.

A: No precipitate was observed at all.
B: Slight precipitation was observed.
C: Considerable precipitation was observed.
D: Severe precipitation was observed.

TABLE 1-(1)

| | Surface Protective Layer | | | | | Emulsion Layer | | |
|---|---|---|---|---|---|---|---|---|
| | Gelatin | Water-Soluble Polymer Compound | | Antistatic Compound | | Gelatin | Water-Soluble Polymer Compound | |
| Sample No. | Content ($g/m^2$) | Compound | Content ($g/m^2$) | Compound* | Content ($g/m^2$) | Content ($g/m^2$) | Compound | Content ($g/m^2$) |
| 1-1 (Control) | 1.6 | — | — | — | — | 1.85 | — | — |
| 1-2 (Comparison) | 1.6 | — | — | 3 | 0.05 | 1.85 | — | — |
| 1-3 (Comparison) | 1.2 | Dextran (mol. wt. 37,000) | 0.4 | 3 | 0.05 | 1.85 | — | — |
| 1-4 (Invention) | 0.7 | Dextran (mol. wt. 37,000) | 0.9 | 3 | 0.05 | 1.85 | — | — |
| 1-5 (Invention) | 0.7 | Dextran (mol. wt. 37,000) | 0.9 | 6 | 0.1 | 1.85 | — | — |
| 1-6 (Invention) | 0.7 | Dextran (mol. wt. 37,000) | 0.9 | 10 | 0.06 | 1.85 | — | — |
| 1-7 (Invention) | 0.7 | Dextran (mol. wt. 37,000) | 0.9 | 13 | 0.06 | 1.85 | — | — |
| 1-8 (Invention) | 0.7 | Dextran (mol. wt. 37,000) | 0.9 | 21 | 0.04 | 1.85 | — | — |
| 1-9 (Invention) | 0.7 | Compound P-8 | 0.9 | 3 | 0.06 | 1.35 | Dextran (mol. wt. 37,000) | 0.5 |
| 1-10 (Comparison) | 0.7 | " | 0.9 | a | 0.06 | 1.35 | Dextran (mol. wt. 37,000) | 0.5 |
| 1-11 (Comparison) | 0.7 | " | 0.9 | b | 0.06 | 1.35 | Dextran (mol. wt. 37,000) | 0.5 |
| 1-12 (Comparison) | 0.7 | Dextran (mol. wt. 37,000) | 0.9 | c | 0.05 | 1.85 | Dextran (mol. wt. 37,000) | 0.5 |
| 1-13 (Comparison) | 0.7 | Dextran (mol. wt. 37,000) | 0.9 | d | 0.05 | 1.85 | Dextran (mol. wt. 37,000) | 0.5 |

*The numbers indicate illustrative compounds of the present invention and the letters a to d indicate the comparative compounds indicated below.

Comparative Compound a

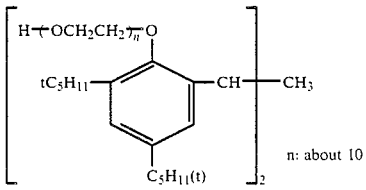

Comparative Compound b

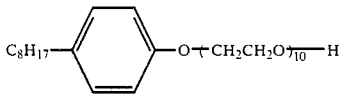

Comparative Compound c

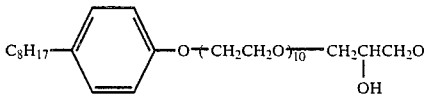

Comparative Compound d

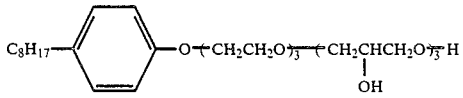

TABLE 1-(2)

| Sample No. | Amount of Organic Material Washed Out during Processing (%) | Drying Time (sec) | Dmax | Static Marks Nylon Rollers | Static Marks Urethane Rollers | Fixing Bath Contamination |
|---|---|---|---|---|---|---|
| 1-1 (Control) | 2 | 36.2 | 2.1 | D | D | A |
| 1-2 (Comparison) | 2 | 35.9 | 2.2 | A | A | A |
| 1-3 (Comparison) | 4 | 28.1 | 2.2 | A | A | A |
| 1-4 (Invention) | 13 | 19.1 | 2.5 | A | A | A |
| 1-5 (Invention) | 14 | 19.0 | 2.4 | A | A | A |
| 1-6 (Invention) | 13 | 19.4 | 2.5 | A | A | A |
| 1-7 (Invention) | 14.5 | 17.9 | 2.7 | A | A | A |
| 1-8 (Invention) | 14 | 19.1 | 2.5 | A | A | A |
| 1-9 (Invention) | 14.5 | 18.4 | 2.4 | A | A | A |
| 1-10 (Comparison) | 13.5 | 18.9 | 2.4 | B | A | D |
| 1-11 (Comparison) | 14 | 19.2 | 2.5 | A | A | D |
| 1-12 (Comparison) | 14 | 19.1 | 2.5 | A | B | D |
| 1-13 (Comparison) | 14 | 19.2 | 2.5 | C | D | C |

As is apparent from the results of Tables 1-(1) and 1-(2), Samples 1-4 to 1-9 using compound of the present invention had fast drying times with no loss of Dmax. No static mark development was seen. The present invention did not visibly contaminate the fixing bath even though a water-soluble polymer was present.

On the other hand, in Sample 1-1 (control), the drying time was increased and Dmax was low because no water-soluble polymer had been used. Moreover, Comparative Samples 1-2 and 1-3 were inadequate with respect to drying time and Dmax because the amount of water-soluble polymer washed out was small. In the case of Comparative Samples 1-10 and 1-13 in which large amounts of polymer and conventional antistatic agents were used in order to improve these factors, there was a marked improvement in the drying time and Dmax, but the improvement was accompanied by contamination of the fixing bath.

As described above, the compounds of the present invention have a markedly improved effect in the development processing method in which organic material is washed out during processing, and they provide excellent pictures and handling properties.

Moreover, in Samples 1-4 to 1-9 of the present invention, swelling in water (21° C., 3 minutes) was 200% or less in all cases.

EXAMPLE 2

2-1 Preparation of the Emulsion Layer Coating Solution

A pebble-like silver iodobromide emulsion with an average grain size 0.6 μm containing 1.4 mol % of silver iodide was prepared using ammonia. After adding 3 mg of chloroauric acid per mol of silver and 10 mg of sodium thiosulfate per mol of silver and carrying out chemical sensitization, 4-hydroxy-6-methyl-1,3,3a,7-tetraazaindene was added in an amount of 70 mg per mol of silver as an antifogging agent. Latex polymer (poly-(ethyl acrylate/methacrylic acid)=97/3) grains on which Compounds BW-1 and BW-2 indicated below (each in an amount of 1.5 wt % of the latex grains) had been adsorbed (0.4 g of latex per square meter), poly(-sodium acrylate) (molecular weight: 200,000, 0.05 mg per square meter) and trimethylolpropane were added to provide the emulsion layer coating solution.

BW-1

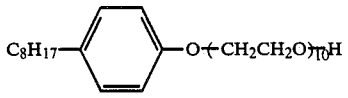

BW-2

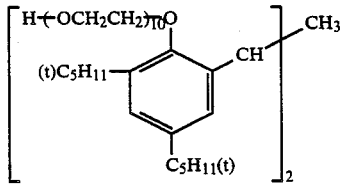

2-2 Preparation of the Protective Layer Coating Solution

| | |
|---|---|
| Lime-treated gelatin | See Table 2 |
| Poly(sodium acrylate) (molecular weight: 600,000) | 0.05 g/m² |
| Poly(potassium styrenesulfonate) (molecular weight: 600,000) | 0.03 g/m² |
| Fluorine-containing compounds: | |

-continued

| | |
|---|---|
| $C_8F_{17}SO_2N(C_3H_7)(CH_2CH_2O)_4(CH_2)_4SO_3Na$ | 0.002 g/m² |
| $C_9F_{19}COO(CH_2CH_2O)_{10}(CH_2CH(OH)CH_2O)_5H$ | 0.003 g/m² |
| 1,2-Bis(vinylsulfonylacetamido)ethane | 0.15 g/m² |

The compounds of the present invention as shown in Table 2 were added to the compounds indicated above with gelatin coating solution (gelatin concentration: 6%) to obtain the protective layer.

2-3 Preparation of the Polymer Layer

A polymer layer coating solution of contents indicated below was prepared

| Lowermost Layer | |
|---|---|
| Gelatin | 0.3 g/m² |
| Polymer A | 0.0575 g/m² |

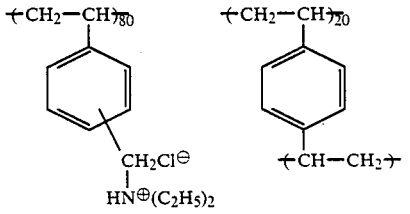

| | |
|---|---|
| Poly(degree of polymerization: 10)-oxyethylene cetyl ether | 0.002 g/m² |
| Polymer (tackifier) | 0.02 g/m² |

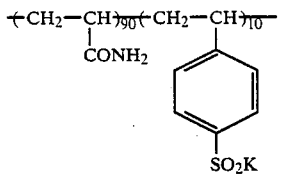

2-4 Preparation of Photographic Films

Photographic films were prepared by coating simultaneously a polymer layer, an emulsion layer and a protective layer onto both sides of an undercoated polyethylene terephthalate support (thickness: 180 μm). The coated silver weight was 3 g per square meter on each side. The samples obtained in this way were tested in the same way as in Example 1.

However, in this case the compositions of the development and fixing baths were as indicated below.

| Development Bath | |
|---|---|
| Potassium Hydroxide | 17 g |
| Sodium Sulfite | 60 g |
| Diethylaminepentaacetic Acid | 2 g |
| Potassium Carbonate | 5 g |
| Boric Acid | 3 g |
| Hydroquinone | 35 g |
| Diethylene Glycol | 12 g |
| 4-Hydroxymethyl-4-methyl-1-phenyl-3-pyrazolone | 1.65 g |
| 5-Methylbenzotriazole | 0.6 g |
| Acetic Acid | 1.8 g |

-continued

| | |
|---|---|
| Potassium Bromide | 2 g |
| Water to make | 1 liter |
| pH adjusted to 10.5 | |
| Fixing Bath | |
| Ammonium Thiosulfate | 140 g |
| Sodium Sulfite | 15 g |
| Ethylenediaminetetraacetic Acid Disodium Salt | 25 mg |
| Sodium Hydroxide | 6 g |
| Water to make | 1 liter |
| pH adjusted to 4.95 with acetic acid | |

The development process was as indicated below.

| | Processing Temperature × Time |
|---|---|
| Development | 35° C. × 11.5 seconds |
| Fixing | 35° C. × 12.5 seconds |
| Water Washing | 20° C. × 7.5 seconds |
| Drying | 60° C. |

Dry to dry processing time: 60 seconds the present invention was used. Dmax was also low and the results obtained with respect to static marks was poor.

As described above, excellent materials with which there is no deterioration with respect to static marks and exhibit no contamination of the fixing bath even though large amounts of organic materials are washed out during processing are thus obtained using the compounds of the present invention.

EXAMPLE 3

3-1 Preparation of the Emulsion Coating Solution 30 g of gelatin, 5 g of potassium bromide and 0.05 g of potassium iodide were added to 1 liter of water and an aqueous solution of silver nitrate (5 g as silver nitrate) and an aqueous solution of potassium bromide containing 0.73 g of potassium iodide were added over a period of 1 minute using the double jet method while stirring in a container maintained at 75° C. Moreover, an aqueous solution of silver nitrate (145 g as silver nitrate) and an aqueous solution of potassium bromide were added using the double jet method. On this occasion the flow rate of the addition was increased progressively so that the flow rate at the end of the addition was 8 times that when the addition was first started. Subsequently, an aqueous solution of 0.37 g of potassium iodide was added.

After addition, the soluble salts were removed at 35° C. using the precipitation method, after which the temperature was raised to 40° C. 60 g of gelatin was then added and the pH was adjusted to 6.5. The temperature was then raised to 56° C. 650 mg of the sensitizing dye, anhydro-5,5'-dichloro-9-ethyl-3,3'-di(3-sulfopropyl)oxacarbocyanine hydroxide (sodium salt) was added and then chemical sensitization was carried out using gold and sulfur sensitization conjointly.

TABLE 2

| | Surface Protective Layer | | | | | Amount of Organic Material | | | Static Marks | | |
|---|---|---|---|---|---|---|---|---|---|---|---|
| | Gelatin | Water-Soluble Polymer Compound | | Antistatic Compound | | Washed Out during | Drying | | Nylon | Urethane | Fixing Bath |
| Sample No. | Content (g/m²) | Compound | Content (g/m²) | Compound* | Content (g/m²) | Processing (%) | Time (sec) | Dmax | Rollers | Rollers | Contamination |
| 2-1 (Control) | 1.6 | — | — | — | — | 1.5 | 38.9 | 2.0 | D | D | A |
| 2-2 (Comparison) | 1.6 | — | — | 3 | 0.06 | 2 | 29.2 | 2.1 | A | A | A |
| 2-3 (Comparison) | 1.2 | Dextran (mol. wt. 37,000) | 0.4 | 5 | 0.06 | 4.5 | 35.2 | 2.3 | A | A | A |
| 2-4 (Invention) | 0.9 | Dextran (mol. wt. 37,000) | 0.7 | 3 | 0.05 | 17 | 17.8 | 2.7 | A | A | A |
| 2-5 (Invention) | 0.8 | Dextran (mol. wt. 37,000) | 0.8 | 2 | 0.05 | 16.5 | 18.0 | 2.6 | A | A | A |
| 2-6 (Invention) | 0.8 | Dextran (mol. wt. 37,000) | 0.8 | 8 | 0.05 | 16.5 | 17.7 | 2.7 | A | A | A |
| 2-7 (Invention) | 0.8 | Polyacrylamide (mol. wt. 8,000) | 0.8 | 10 | 0.045 | 15 | 17.1 | 2.7 | A | A | A |
| 2-8 (Invention) | 0.8 | Polyacrylamide (mol. wt. 8,000) | 0.8 | 20 | 0.1 | 14 | 18.5 | 2.6 | A | B | A |
| 2-9 (Invention) | 0.8 | Compound P-12 | 0.8 | 3 | 0.06 | 15.5 | 19.2 | 2.6 | A | A | A |
| 2-10 (Comparison) | 0.8 | Dextran (mol. wt. 37,000) | 0.8 | b | 0.06 | 17.5 | 17.9 | 2.6 | A | A | D |
| 2-11 (Comparison) | 0.8 | Dextran (mol. wt. 37,000) | 0.8 | c | 0.06 | 17.5 | 18.2 | 2.7 | A | B | D |
| 2-12 (Comparison) | 0.8 | Dextran (mol. wt. 37,000) | 0.8 | a | 0.03 | 17.5 | 17.9 | 2.6 | C | D | C |
| 2-13 (Comparison) | 0.8 | Dextran (mol. wt. 37,000) | 0.8 | a | 0.1 | 17.5 | 18.0 | 2.6 | A | A | D |
| 2-14 (Comparison) | 0.8 | Polyacrylamide (mol. wt. 8,000) | 0.8 | d | 0.06 | 17 | 18.2 | 2.6 | A | B | D |

*The numbers indicate the numbers of illustrative compounds and the letters indicate comparitive compounds.

As is apparent from the results of Table 2, Samples 2-4 to 2-9 of the present invention provided a washing out of at least 10% in processing and dried quickly. These samples provided excellent pictures which were satisfactory with respect to Dmax, static marks and fixing bath contamination.

On the other hand, Sample 2-1 (Control) did not contaminate the fixing bath since no water-soluble polymer or compound of the present invention was present, but it was poor with respect to drying time, Dmax and static marks. Furthermore, Comparative Samples 2-10 to 2-14 in which a conventional antistatic agent was used exhibited pronounced contamination of the fixing bath since the water-soluble polymer was washed out and the fixing bath became unusable. Moreover, drying of Samples 2-3 was slow where only the compound of The emulsion obtained contained hexagonal tabular grains with projected area diameter of 85 μm and average thickness of 0.158 μm. 4-Hydroxy-6-methyl-1,3,3a,7-tetraazaindene and 2,6-bis(hydroxyamino)-4-diethylamino-1,3,5-triazine were added to the emulsion as stabilizers, trimethylolpropane polyacrylamide (molecular weight: about 70,000) was added to provide a coated amount of 0.1 g per square meter, polymer latex (grains of poly(ethyl acrylate/styrenesulfonic acid: 96/4) pretreated with Compounds BW-1 and BW-2 as used in Example 2 (2 wt % of each), grain size: 0.1 μm) (0.5 g of latex per square meter), poly(potassium styrene sulfonate) (molecular weight: 600,000, 0.05 g per square meter), poly(sodium acrylate) (molecular weight: 200,000, 0.03 g per square meter) and dichlorotriazine sodium salt were added as anti-dry fogging agents to provide the emulsion layer coating solution.

3-2 Preparation of the Protective Laver Coating Solution

Fourteen types of coating solutions with the same compositions as those used for the surface protective layers indicated in Table 2 of Example 2 were used to prepare Samples 3-1 to 3-14.

3-3 Preparation of the Support

A latex (main component of styrene/butadiene) was coated onto both sides of a blue colored polyethylene terephthalate support and this coated support was further overcoated on both sides with gelatin (0.085 g/m$^2$), Polymer A (as in Example 2-3, 0.058 g/m$^2$), the dye of which the structure is indicated below (0.017 g/m$^2$), dichlorohydroxytriazine (0.01 g/m$^2$), poly(degree of polymerization: 10)oxyethylene p-nonylphenol ether (0.015 g/m$^2$) and polymer particles (poly(methyl methacrylate/acrylic acid, mol ratio: 97/3, particle size: 1.8 μm, 0.01 g/m$^2$) and dried to provide the support.

Dye

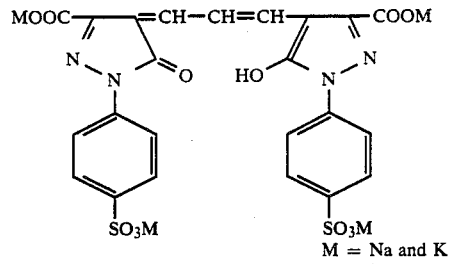

3-4 Preparation of the Photographic Films

The emulsion layer coating liquid and the protective layer coating solution were coated simultaneously onto both sides of the above-mentioned support to provide protective layers corresponding to those of Example 2 and the coated layers were dried to provide Samples 3-1 to 3-14. The coated silver amount was 1.9 g per square meter on each side of the support.

The samples obtained were tested with respect to performance in the same way as in the aforementioned Example 2. The results are provided in Table 3.

Moreover, the degree of swelling in water (21° C., 3 minutes) was not more than 250% with Samples 3-4 to 3-9 of the present invention.

TABLE 3

| Sample No. | Amount of Organic Material Washed Out during Processing (%) | Drying Time (sec) | Dmax | Static Marks: Nylon Rollers | Static Marks: Urethane Rollers | Fixing Bath Contamination |
|---|---|---|---|---|---|---|
| 3-1 (Control) | 2.5 | 36.7 | 2.6 | D | D | A |
| 3-2 (Comparison) | 2.5 | 37.9 | 2.6 | A | A | A |
| 3-3 (Comparison) | 5.5 | 33.5 | 2.8 | A | B | A |
| 3-4 (Invention) | 14 | 16.9 | 3.3 | A | A | A |
| 3-5 (Invention) | 14 | 18.0 | 3.3 | A | A | A |
| 3-6 (Invention) | 14 | 17.9 | 3.2 | A | A | A |
| 3-7 (Invention) | 15.5 | 17.3 | 3.2 | A | A | A |
| 3-8 (Invention) | 15 | 17.6 | 3.3 | B | A | A |
| 3-9 (Invention) | 15 | 17.9 | 3.2 | A | A | A |
| 3-10 (Comparison) | 14.5 | 17.3 | 3.3 | A | A | D |
| 3-11 (Comparison) | 14.5 | 17.8 | 3.2 | A | B | D |
| 3-12 (Comparison) | 14.5 | 17.5 | 3.1 | C | D | D |
| 3-13 (Comparison) | 14.5 | 18.0 | 3.3 | A | A | D |
| 3-14 (Comaprison) | 15 | 17.3 | 3.3 | A | B | D |

As is apparent from the results of Table 3, Samples 3-4 to 3-9 of the present invention dried rapidly, were satisfactory with respect to Dmax and static marks and did not contaminate the fixing bath.

On the other hand, Sample 3-1 (Control) did not contaminate the fixing bath since it did not contain a sufficient amount of water-soluble polymer and did not contain any compound of the present invention However, the control was unsatisfactory with respect to Dmax, drying time and static marks.

Comparative Samples 3-2 and 3-3 which contained compounds of the present invention but which contained inadequate amounts of water-soluble polymer were good with respect to static marks but were inadequate with respect to Dmax and drying time.

Furthermore, Samples 3-10 to 3-14 in which Comparative Compounds a to d were used contaminated the fixing bath.

As described above, sensitive materials which contain specified water-soluble polymers and compounds of the present invention are clearly greatly superior to conventional sensitive materials.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one light-sensitive silver halide emulsion layer and at least one other hydrophilic colloid layer, wherein at least one compound represented by formula (I) is contained in at least one layer of said silver halide photographic material and wherein an organic material selected from the group consisting of a natural or synthetic water-soluble polymer is contained in at least one of said light-sensitive silver halide emulsion layer and said other hydrophilic colloid layer such that at least 10% by weight of the organic material originally present in said layer of said silver halide photograpic material is washed out from said layer during development processing:

$$A—X—Y—B \qquad (I)$$

wherein A represents an alkyl group having from 8 to 25 carbon atoms, an alkenyl group having from 8 to 25 carbon atoms or an aryl group having from 8 to 25 carbon atoms; X represents $$-O-,\ -\underset{\underset{O}{\|}}{C}O-,\ -S-,\ -\underset{\underset{R}{|}}{N}-,\ -\underset{\underset{R}{|}}{C}ON-,\ \text{or}\ -SO_2\underset{\underset{R}{|}}{N}-$$

wherein R represents an alkyl group having from 1 to 10 carbon atoms or —Y—B; Y represents a group consisting of at least one of each of the units $$\left(CH_2-CH_2O\right)_a \text{ and } \left(CH_2\underset{\underset{OH}{|}}{C}HCH_2O\right)_b.$$

wherein a represents from 5 to 50; and b represents from 2 to 20; and B represents hydrogen or an alkyl group having not more than 8 carbon atoms, an alkylcarbonyl group having not more than 8 carbon atoms, or a phenyl group having not more than 8 carbon atoms.

2. The silver halide photographic material as claimed in claim 1, wherein said compound represented by formula (I) is contained in a surface protective layer or a backing layer.

3. The silver halide photographic material as claimed in claim 1, wherein the amount of said compound represented by formula (I) used is from 0.0001 to 2.0 g per square meter of the sensitive material.

4. The silver halide photographic material as claimed in claim 1, wherein said organic material is a natural water-soluble polymer selected from the group consisting of lignin, starch, pluran, cellulose, alginic acid, dextran, dextrin, guam gum, gum arabic, glycogen, laminaran, licherin, nigeran, glucose polymers, or derivatives thereof.

5. The silver halide photographic material as claimed in claim 1, wherein said organic material is a water-soluble polymer having from 10 to 100 mol % of a repeating unit represented by formula (P) having a molecular weight of from 10,000 to 20,000, and having a solubility of at least 0.05 g per 100 g of water at 20° C.:

$$\left(\underset{\underset{Y}{|}}{\overset{\overset{R_1}{|}}{C}}-\overset{\overset{R_2}{|}}{C}\right)\ \ (L)_p(J)_qQ \qquad (P)$$

wherein $R_1$ and $R_2$ may be the same or different, and each represents a hydrogen atom, an unsubstituted or substituted alkyl group; Y represents a hydrogen atom or $(L)_p(J)_qQ$; L represents —CONH—, —NHCO—, —COO—, —OCO—, —CO— or —O—; J represents an unsubstituted or substituted alkylene group, an unsubstituted or substituted arylene group, $$\left(CH_2CH_2O\right)_m\left(CH_2\right)_n,\ \left(CH_2\underset{\underset{OH}{|}}{C}HCH_2O\right)_m\left(CH_2\right)_n$$

(wherein m is an integer of 1 to 40 and n is an integer of 0 to 4); Q represents

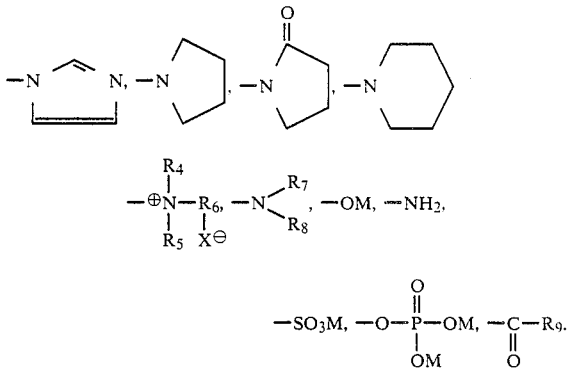

a hydrogen atom or a group represented by $R_3$ (wherein M represents a hydrogen atom or a cation, $R_9$ represents an alkyl group having from 1 to 4 carbon atoms, $R_3$, $R_4$, $R_5$, $R_6$, $R_7$ and $R_8$ each represents a hydrogen atom, an alkyl group having from 1 to 20 carbon atoms, an alkenyl group, a phenyl group, or an aralkyl group, and X represents an anion); p and q each represents 0 or 1.

6. A process which comprises developing an exposed silver halide photographic material of claim 1, wherein at least 10% by weight of said organic material originally present in said layers is washed out during said developing.

* * * * *